US005577891A

United States Patent [19]

Loughnane et al.

[11] Patent Number: 5,577,891

[45] Date of Patent: Nov. 26, 1996

[54] LOW POWER PORTABLE RESUSCITATION PUMP

[75] Inventors: Michael H. Loughnane, Lafayette Hill; Kenneth P. Cook, Blue Bell, both of Pa.

[73] Assignee: Instech Laboratories, Inc., Plymouth Meeting, Pa.

[21] Appl. No.: 322,483

[22] Filed: Oct. 14, 1994

Related U.S. Application Data

[63] Continuation-in-part of Ser. No. 159,906, Nov. 30, 1993, Pat. No. 5,415,532.

[51] Int. Cl.[6] ..... F04B 43/08

[52] U.S. Cl. ..... 417/53; 417/412; 417/478

[58] Field of Search ..... 417/411, 53, 412, 417/474, 475, 360, 477.3, 477.5, 477.2, 478; 604/153

[56] References Cited

U.S. PATENT DOCUMENTS

| | | | |
|---|---|---|---|
| 1,922,196 | 8/1933 | Butler | 417/475 |
| 2,285,974 | 6/1942 | Huber | 417/475 |
| 2,546,852 | 3/1951 | Corneil | 417/475 |
| 2,629,333 | 2/1953 | Olden | 417/475 |
| 2,769,397 | 11/1956 | Bulger | 417/474 |
| 2,818,815 | 1/1958 | Conneil | 417/475 |
| 2,915,983 | 12/1959 | Berrian | 418/45 |
| 3,046,903 | 7/1962 | Jones | 417/475 |
| 3,417,707 | 12/1968 | Zimmer | 417/475 |
| 3,606,596 | 9/1971 | Edwards | 417/478 |
| 3,720,485 | 3/1973 | Holman, Jr. | 417/475 |
| 4,012,178 | 3/1977 | Puckett | 417/478 |
| 4,014,318 | 3/1977 | Dockum et al. | 128/1 D |
| 4,170,439 | 10/1979 | Hase | 417/413 |
| 4,250,872 | 2/1981 | Tamari | 417/394 |
| 4,439,112 | 3/1984 | Kitsnik | 417/383 |
| 4,483,666 | 11/1984 | Schubert et al. | 418/45 |
| 4,925,377 | 5/1990 | Inacio et al. | 417/472 |
| 4,995,864 | 2/1991 | Bartholomew et al. | 604/153 |
| 5,033,943 | 7/1991 | Durrum et al. | 417/475 |
| 5,044,900 | 9/1991 | Cavallaro | 417/466 |
| 5,158,528 | 10/1992 | Walker et al. | 417/411 |
| 5,188,603 | 2/1993 | Vaillancourt | 604/131 |
| 5,415,532 | 5/1995 | Loughnane et al. | 417/411 |

FOREIGN PATENT DOCUMENTS

| | | | |
|---|---|---|---|
| 1211359 | 11/1960 | France | 417/475 |
| 1375925 | 9/1964 | France | 417/412 |
| 0001603 | 1/1977 | Japan | 417/475 |
| 197711 | 11/1977 | U.S.S.R. | 417/474 |
| 1707232 | 1/1992 | U.S.S.R. | 417/475 |

*Primary Examiner*—Timothy Thorpe
*Assistant Examiner*—Peter G. Korytnyk
*Attorney, Agent, or Firm*—Foley & Lardner

[57] ABSTRACT

A pump and a method for pumping liquid or fluid through a pair of resilient tubes includes a pushing mechanism which partially compresses the tubes in a balanced, alternating, rocking manner. The resilient tubes are held in a parallel relationship. The pushing mechanism alternately compresses the tubes. As one of the two parallel tubes is compressed, fluid is pumped out of the tube and at the same time fluid is drawn into the second tube as the latter tube resumes its original shape. The resilience of both tubes also is used to assist the pumping action in a balanced fashion, thereby providing a pump that has low power consumption and is lightweight.

14 Claims, 9 Drawing Sheets

LOW POWER PORTABLE RESUSCITATION PUMP

BACKGROUND OF THE INVENTION

The present application is a continuation-in-part application of U.S. patent application Ser. No. 08/159,906, filed Nov. 30, 1993, entitled "HIGH EFFICIENCY BALANCED OSCILLATING SHUTTLE PUMP," now U.S. Pat. No. 5,415,532, herein incorporated by reference.

This invention relates in general to a high-efficiency portable pump, and in particular, to a lightweight portable pump characterized by low power consumption.

Conventional pumps used for pumping liquid or fluids through tubes utilize a piston-type plunger which momentarily occludes the tubes to effect pumping. Such a device, used in circulatory assist devices, is illustrated in U.S. Pat. No. 4,014,318. A conventional pump utilizing a series of pistons to successively compress, and completely occlude a tube which carries the liquid to be pumped is illustrated in FIG. 1. Pumping mechanism 10 pumps liquids through a tube 14. Three pumping pistons 11, 12 and 13 act in series to pump liquid through the tube 14. Piston 11 completely occludes tube 14. While tube 14 is held occluded, piston 12 compresses and occludes the tube 14 to urge liquid in the direction of arrow 15. The occlusion of piston 11 during compressions of tube 14 by piston 12 causes the liquid to be pumped in the desired direction. Similarly, piston 13 operates in conjunction with piston 12.

One drawback of conventional pumps is that the total occlusive nature of the pumping action reduces efficiency. Further, the occlusion utilized in such pumps has the effect of damaging cells when the pump is used to pump sensitive fluids such as blood. The shown piston relationship is relatively bulky and has a high power consumption.

SUMMARY OF THE INVENTION

An object of the instant invention is to provide a low power portable pump, particularly adapted for use in resuscitation, which overcomes the drawbacks of conventional pumps. In accordance with this objective, there is provided a pump for pumping fluid which includes a first and a second resilient tube, each having an original shape and being held in a substantially parallel relationship and a pushing mechanism which, when positioned adjacent the first and second resilient tubes is driven between a first and second position to alternately partially compress the first and second resilient tubes. The pump further includes input and output check valves on each of the first and second resilient tubes such that a first portion of the fluid is pumped out of the first resilient tube as it is compressed and a second portion of the fluid is drawn into the first resilient tube as the first resilient tube resumes its original shape.

In accordance with the instant invention, there is also provided a method for pumping fluid through a pair of resilient tubes which includes the steps of placing the resilient tubes adjacent a pushing mechanism; rotating the pushing mechanism between a first and second position, and alternately compressing the first and second tubes in the first and second positions respectively. According to this method, a portion of the fluid is discharged from the tube while the tube is compressed and a second portion of the fluid is drawn into the tube while the tube resumes its original shape. Moreover, the potential energy stored in the compressed tube is restored to the system as operates.

BRIEF DESCRIPTION OF THE DRAWINGS

The above stated and other objectives will be readily apparent from the detailed description of the various embodiments of the invention which are described below by reference to the following figures wherein.

DETAILED DESCRIPTION OF THE PREFERRED EMBODIMENT

Figure 1:
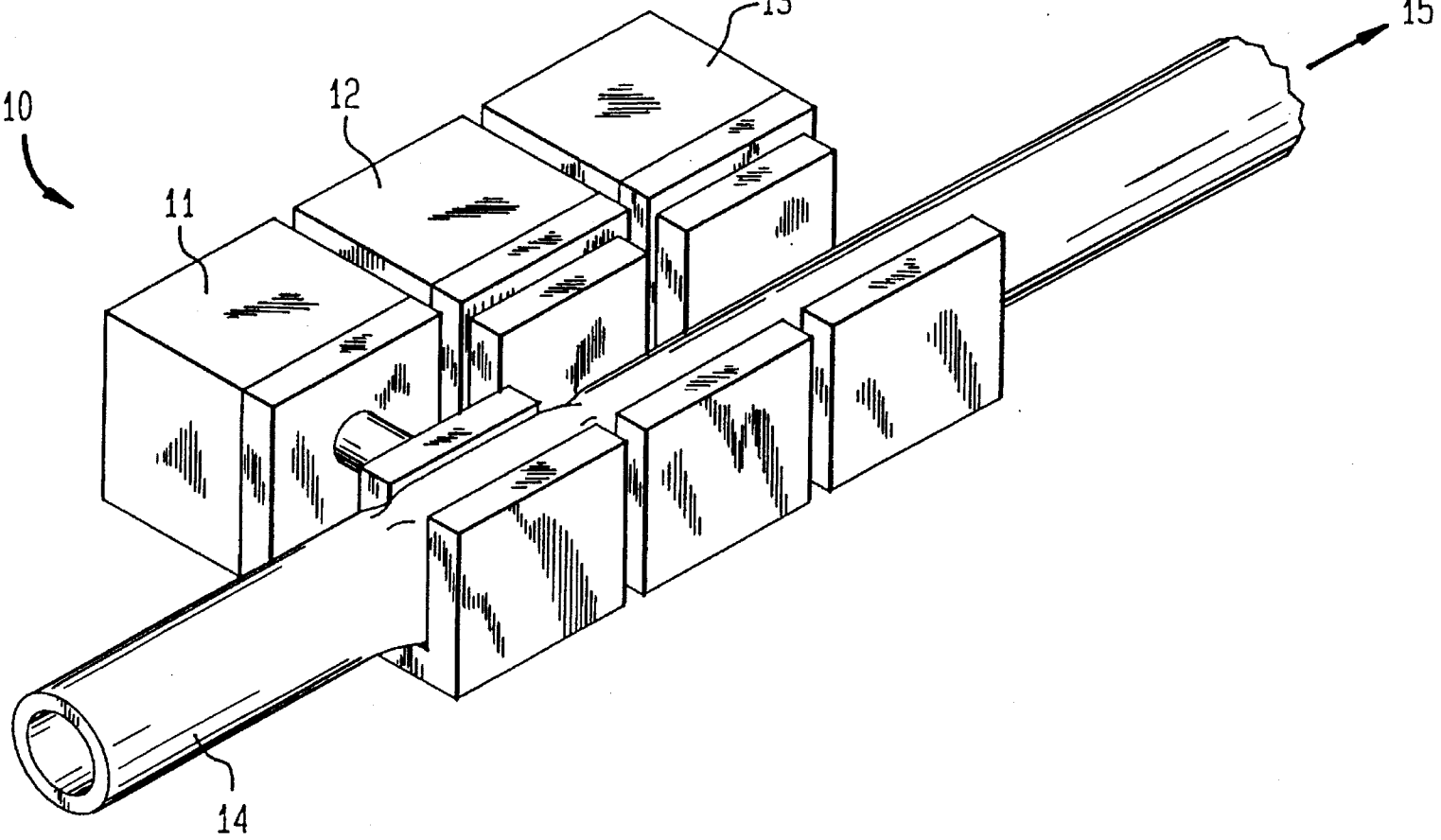
FIG. 1 (PRIOR ART)
FIG. 1 illustrates a prior art pump for pumping a fluid through a tube.

A low power portable pump according to the instant invention provides a very lightweight pump with very low power requirements. Such pumps may be used for the delivery of resuscitation fluids in situations where the portability of the pump is important such as emergency situations, combat casualties, etc, to eliminate the gravity-driven systems currently used. Another distinctive feature of the instant invention is its low power consumption. This makes it useful for delivery of tissue culture fluids to biocartridges used to grow cells aboard NASA's space shuttle vehicles. Under battery power, such a pump may be operated for long durations on the order of days to weeks.

The operation of a low power portable pump according to a first embodiment of the instant invention is illustrated in FIGS. 2A–2D. The pump is shown generally at reference numeral 100. The pump operates by partially compressing at least two parallel resilient tubes 101 and 102 in an alternating fashion against flat stops 105. Tubes 101 and 102 are compressed by the sides 106 of a linearly driven oscillating shuttle block 110. Input check valves 103 and output check valves 104 are located on opposite ends of the resilient pumping tubes 101 and 102. The resiliency of tubes 101 and 102 is used to refill a partially emptied tube as the tube returns to its original shape and aids in the pumping action. This operation is more fully described below.

FIGS. 2A–2D show the general operation of the pump 100 through a full cycle of the shuttle block 110. The shuttle guide is not shown for clarity of illustration. Fluid flows into and-out of the tubes 101 and 102 as illustrated by the arrows.

Figure 6B:
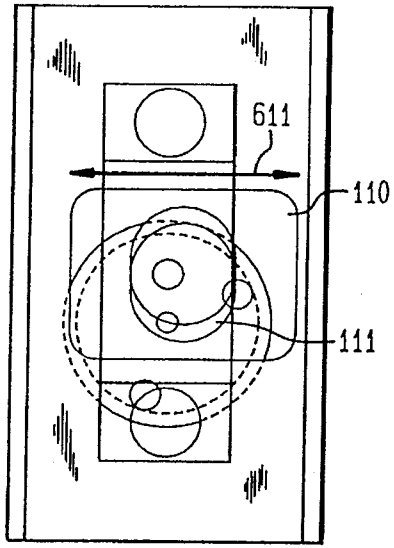
FIGS. 6A and 6B illustrate the shuttle block and motor configuration, respectively, for an embodiment according the instant invention.
Figure 6A:
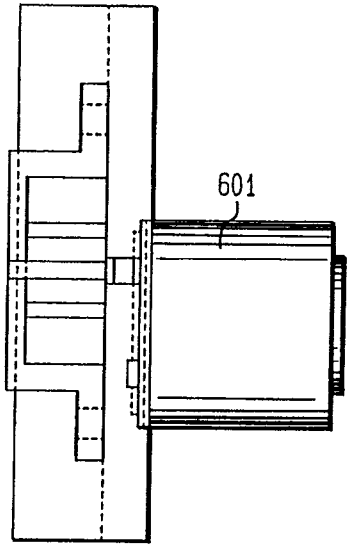

In this embodiment, as further illustrated in FIGS. 6A and 6B, the shuttle block 110 is driven by an eccentric 111 on the shaft of a high efficiency electric motor 601. The motor may be any suitable motor having the desired efficiency and driving characteristics. This motion produces an oscillating linear motion of the shuttle block 110 as shown by arrow 611 in FIG. 6B. The linear motion is sinusoidal in nature.

Efficient operation is achieved by the arrangement of the tubes 101 and 102 and the shuttle block 110. The balanced operation of the interaction of the shuttle block 110 and the tubes 101 and 102 adds to the pump's efficiency. Limiting the travel of the shuttle block 110 such that total occlusion of the tubes 101 and 102 never occurs (i.e., tubes 101 and 102 are only partially compressed at the end of the shuttle block's 110 motion in a particular direction) also increases efficiency and contributes to other beneficial characteristics of the pump as further described below.

Figure 2D:
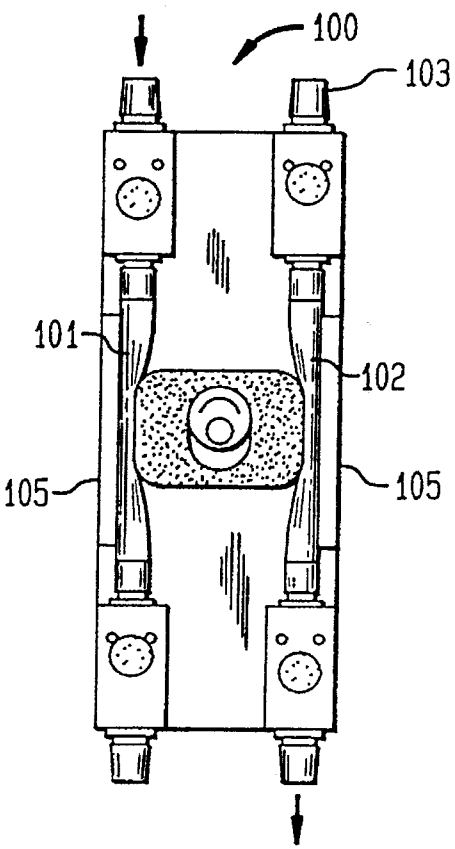
FIGS. 2A–2D illustrate the shuttle block and tube configuration and operation according to an embodiment of the instant invention.
Figure 2C:
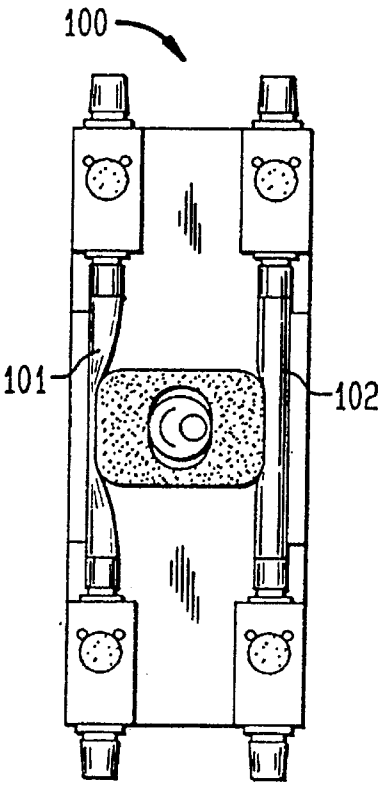
Figure 2B:
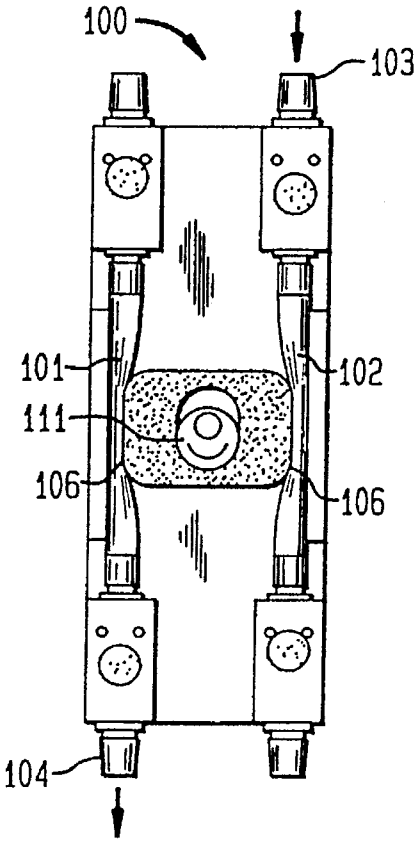
Figure 2A:
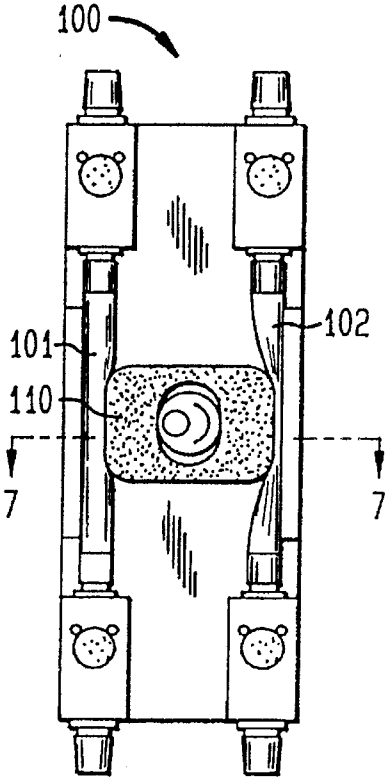
Figure 3:
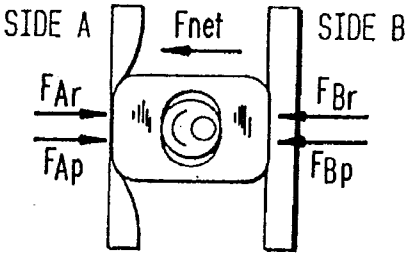
FIG. 3 illustrates a force description of the tube and shuttle block according to the balanced operation of an embodiment of the instant invention.
Figure 7:
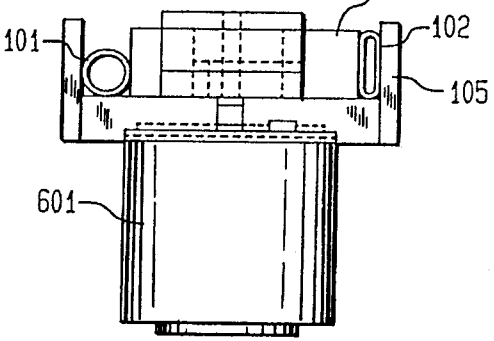
FIG. 7 illustrates a cross section of the shuttle block, tubes and motor according to an embodiment of the instant invention.

As illustrated in FIG. 2B, each of the tubes may be slightly compressed by the sides of the shuttle block 106 when the shuttle block 110 is in the center position. The operation of the pump 100 will be further described in connection with FIG. 2A, along with FIG. 7 which illustrates a view along line 7—7. In FIG. 2A, the force delivered by the shuttle block 110 must overcome the resiliency of tube 102 ($F_{Ar}$) as well as the force produced by the pressure of the fluid which is located within tube 102 ($F_{Ap}$). Because of the balanced arrangement, while one tube 102 is being compressed the other tube 101 is expanding. The common shuttle block 110 experiences forces in opposite directions from the two tubes 101 and 102 and the force exerted by the fluid therein. In other words, the resiliency of the tubes 101 and 102 as well as the force of the fluid within the tubes reciprocates part of the force originally used to compress the tube, stored as potential energy in the system, back into the shuttle block 110. In this manner, the potential energy is used to aid the shuttle block 110 as it compresses the opposite tube. Thus, the only driving force which must be supplied by the motor 601 is the vector sum of these forces ($F_{net}$) (i.e., the difference between these forces) plus any additional force necessary to overcome frictional forces within the system. This relationship is depicted graphically in FIG. 3 and is represented by the equation:

$$F_{net}=F_{Ar}+F_{Ap}-F_{Br}-F_{Bp}+F_{friction}$$

One advantage of the instant invention is that a significant portion of the stored potential energy held in the resilience of the tube is returned to the drive system during the refilling cycle. Refilling of tube 102 is shown in FIG. 2B. Additional liquid or fluid is drawn into the tube 102 through input check valve 103. A portion of the potential energy stored in compressed tube 102 is used to fill the interior chamber of tube 102, open the input check valve 103 and overcome frictional/viscous losses within the tube itself. The remaining portion of the potential energy is returned to the shuttle block 110.

The net force that the shuttle block 110 must deliver is essentially sinusoidal in amplitude, and reaches a maximum at the limits of excursion in either direction. Care is taken to not completely compress (occlude) the resilient tubes 101 and 102 at the end of the shuttle block 110 motion. Such total occlusion results in very high forces, is wasteful of energy and is not required for the pumping action. Further, when the pump is to be used to pump sensitive fluids such as blood, the instant design avoids damage to the cells, as is experienced with totally occlusive designs.

A working pump according to the first embodiment of this invention was constructed as follows. Silastic pump tubing (⅛"×3/16") manufactured by Manostat was used for tubes 101 and 102. The shuttle block 110, housing and connector were manufactured by Instech, Laboratories, Inc. A motor 601, Model 2020C produced by MicroMo Electronics was used. The choice of input and output check valves 103 and 104 depends upon desired pumping pressures and other parameters. Duckbill valves Model 1300-104 manufactured by Vernay Laboratories, Inc. are especially useful when the pump is used to pump blood in order to reduce any damage to the blood. Such a pump is small in size (2"×3"), light weight (60 gm) and has very low power consumption (60 mW at 15 ml/min at Δp=0). Such a pump is also capable of delivering up to 40 ml/min unloaded.

The shuttle pump of the first embodiment may also include a pump controller (not shown) to monitor the rotational speed of the pump or the flow rate and to control the movement of shuttle block 110. The speed controller may monitor the back emf of the motor 601 to automatically adjust the motor's operation to the proper back emf values, and thus, cause the pump to operate at a constant speed. Such a controller may be, for example, model S100 manufactured by Instech. The particular back emf value corresponding to the desired flow rate may be predetermined, for example, and the motor is then controlled until the particular back emf is achieved if operating characteristics corresponding to a particular fluid are known. Alternatively, the flow may be directly measured and the motor may be controlled until the desired flow rate is obtained.

As stated above, one factor contributing to the high efficiency of a pump according to the instant invention is the pump's use of a balanced operating arrangement. The principle behind the balanced operation may be more readily understood according to the following spring model. The use of springs provides a reasonable approximation for the resilient tubes 101 and 102.

Figure 4B:
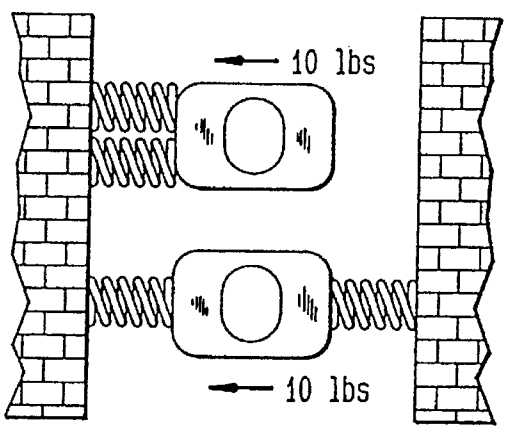
FIGS. 4A, 4B and 4C illustrate a spring model of the balanced operation embodied in the instant invention.
Figure 4A:
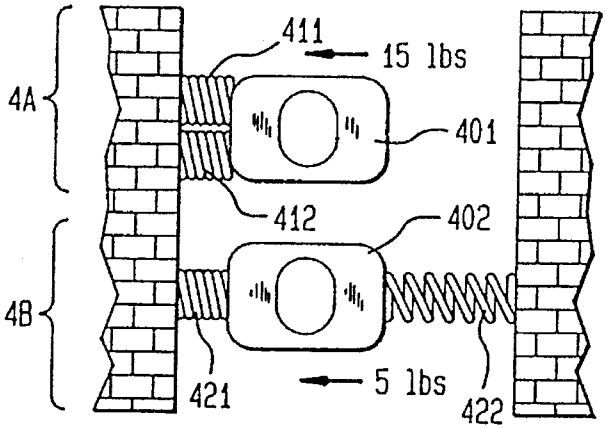
Figure 4C:
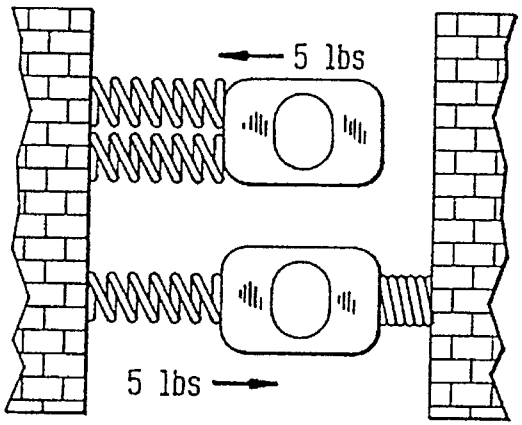

A comparison is based on the two spring models shown in FIGS. 4A, 4B and 4C. The upper half of FIGS. 4A, 4B and 4C depicts two springs 411 and 412 on the same side of driving block 410. This approximates a pumping action which utilizes a piston driven against a single tube. The lower half of FIGS. 4A, 4B and 4C illustrates the two springs 421 and 422 on each side of block 402. This arrangement models the balanced operation of the instant invention. Both arrangements would result in equal flow rates. Work requirements for one half cycle of single sided and balanced arrangements are calculated below. The other half of the cycles are identical. Frictional losses are neglected in this analysis. The spring model uses a preload. This preload corresponds to the partial compression by shuttle block sides 106 on both tubes 101 and 102 when the shuttle block 110 is in the center position as illustrated in FIG. 2B as well as the internal pressure that the liquid exerts on the tubes as a result of the source hydrostatic pressure.

The following assumptions are used for the model:

All springs are identical and have a spring constant k=10 lbs/in;

Springs have a resting length of 1";

Springs start compressed to 0.5" at center point of excursion;

Shuttle excursion is +/−0.25";

The amount of compression is denoted by x; and

Force generated by any of the springs is given by F=kx.

While both arrangements exhibit a difference in force of 10 lbs from end to end, the work performed to achieve these two states is different. Work is defined as follows:

$$\text{Work}=\int_{xi}^{xf} F\,dx$$

Since the springs are linear devices, measuring the area under the force-displacement curve is equivalent to calculating the integral. Since power is work/time, work ratios are the same as power ratios.

Figure 5B:
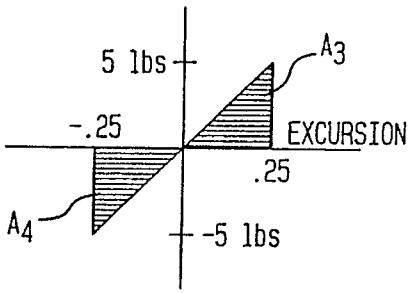
FIGS. 5A and 5B illustrate a force displacement plot for the single-sided pumping arrangement and the balanced pumping arrangement, respectively shown in upper and lower halves of FIGS. 4A, 4B and 4C.
Figure 5A:
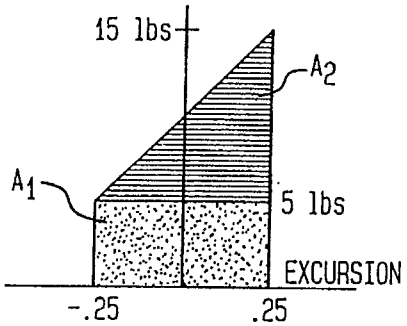

From FIG. 5A we see that, $A_1=0.5\times5=2.5$ in-lbs (results from preloading of springs) and $A_2=\frac{1}{2}\times10\times0.5=2.5$ in-lbs. The total work$=A_1+A_2=5$ in-lbs for the single sided configuration. At best, if all preloading was eliminated, the work will reduce to 2.5 in-lbs, i.e., $A_1=0$.

From FIG. 5B we see that $A_3=A_4=\frac{1}{2}\times0.25\times5=0.625$ in-lbs. In the balanced case, the magnitude of the preload has no effect on the work performed as long as k and displacement are unaltered.

As the above comparison illustrates, the power requirements would be 4 times higher for the single sided approach and will never go below 2 times higher, even if all preloads could be eliminated. The second order effects such as frictional losses will also be reduced in the balanced situation since the absolute value of the forces involved are less. Part wear is also lower.

As the pressure increases inside of the pumping tubes, to a first order approximation, it is similar to increasing the spring constant from k to (k+kp) and thereby increasing the preload. Again, the balanced pump arrangement only requires that the driving mechanism overcome the difference in resiliency forces and the difference in pressure forces. While the ratio of power required will remain unchanged, the difference of the absolute value of the power requirements will increase. For example, doubling k to 2k because of increased pressure, will increase single sided work to 10 in-lb and balanced work to 2.5 in-lb. The ratio will still be 4:1 but the work difference will now be 7.5 in-lb instead of 3.75 in-lb.

In one modification of the first embodiment, the pumping capacity is increased. If, for example, the pump is to be used for resuscitation purposes, the design should be modified. While a pump which delivers up to 40 ml/min is adequate for maintenance of a moderately stable patient, it would need to have a capacity of about 5 times this for aggressive resuscitation efforts. This scaling up can be accomplished by increasing the footprint of the shuttle block and the diameter of the pump tubes. This scaled up version would require more power. Doubling the diameter of the tubes, for example, would theoretically give a 4-fold increase in flow rate with the same block size. More than one pump may be used together to achieve higher pumping capacity.

A second embodiment of the instant invention will now be described in connection with FIGS. 8A–8C and 9A–9B. In accordance with the second embodiment of the instant invention, the above described principles of balance operations are utilized in a geometry which facilitates a more simple replacement of the sterile portion of the low power pump in which the tubes are mounted. In accordance with the second embodiment, the pump 800 includes a main pump body 802, a battery pack 804, and a rocking pusher mechanism 806. There is also provided a removable sterile cartridge 808 (FIGS. 8B–8C) having an input port 810 and an output port 812 and being adapted to be secured to the main pump body 802. The removable sterile cartridge 808 receives a fluid to be pumped through the input port 810, pumps under the operation of the rocking pusher mechanism 806, and discharges the fluid out through output port 812.

Figure 8A:
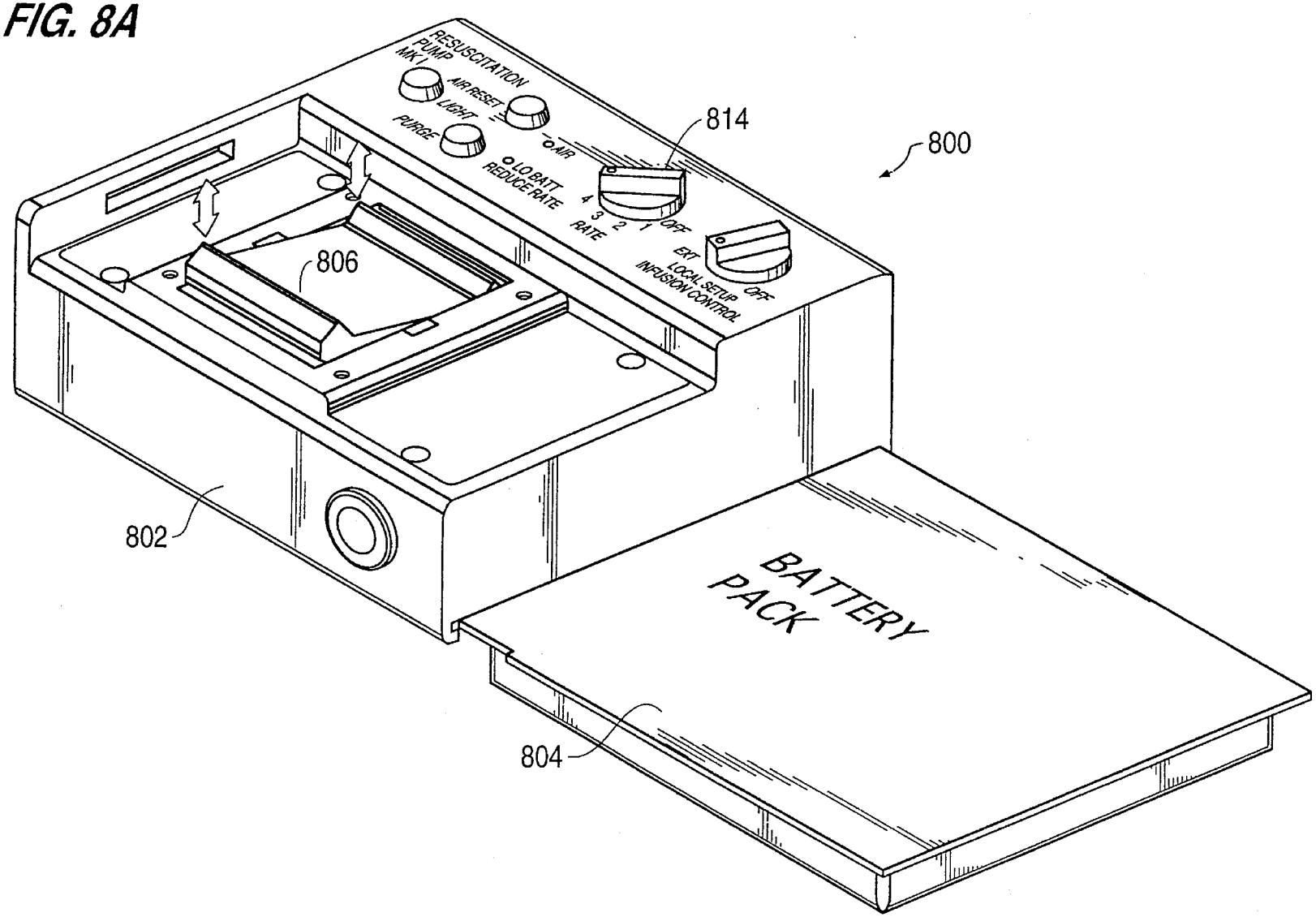
FIGS. 8A–8C illustrate a low power pump according to a second embodiment of the invention.
Figure 8B:
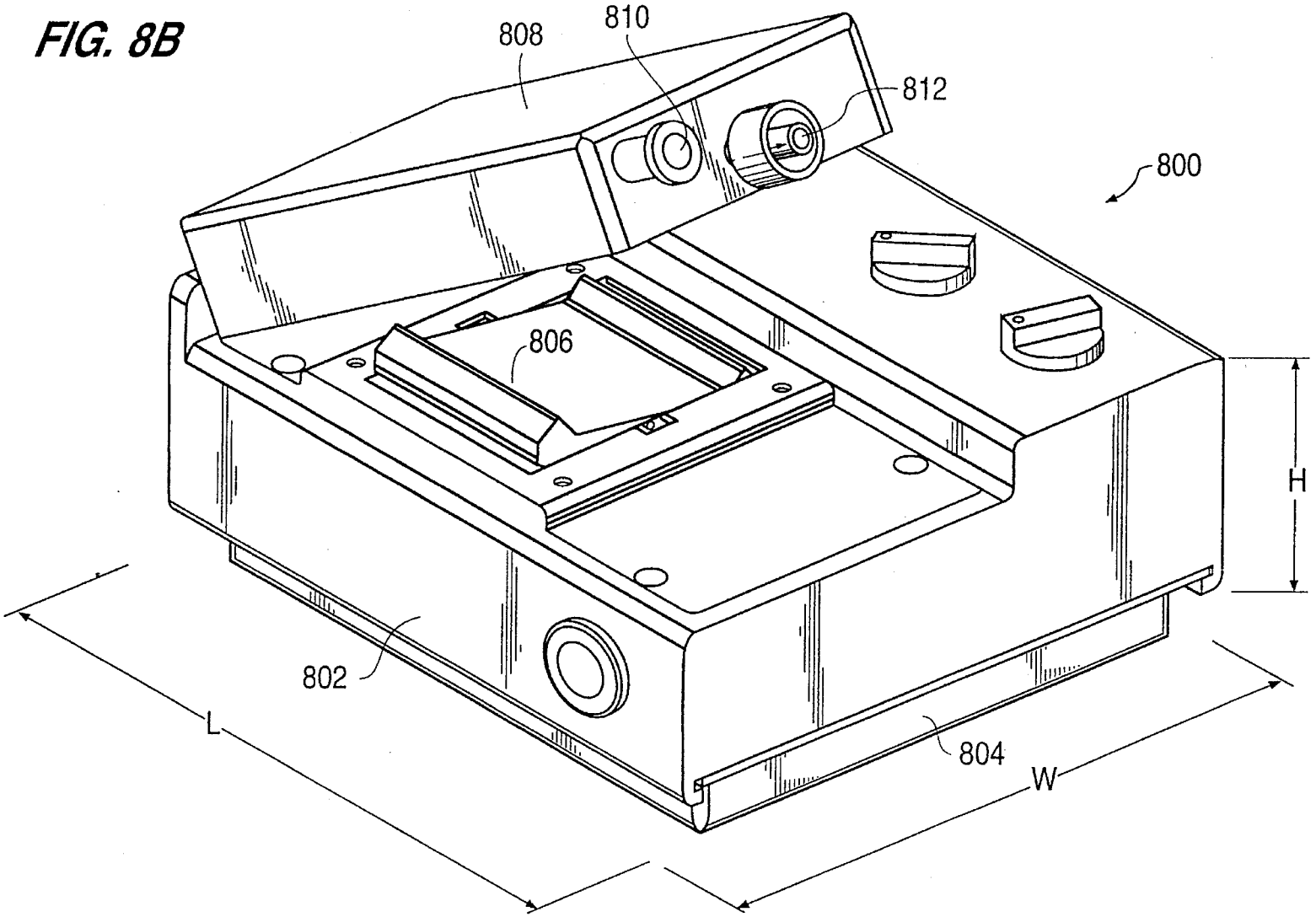
Figure 8C:
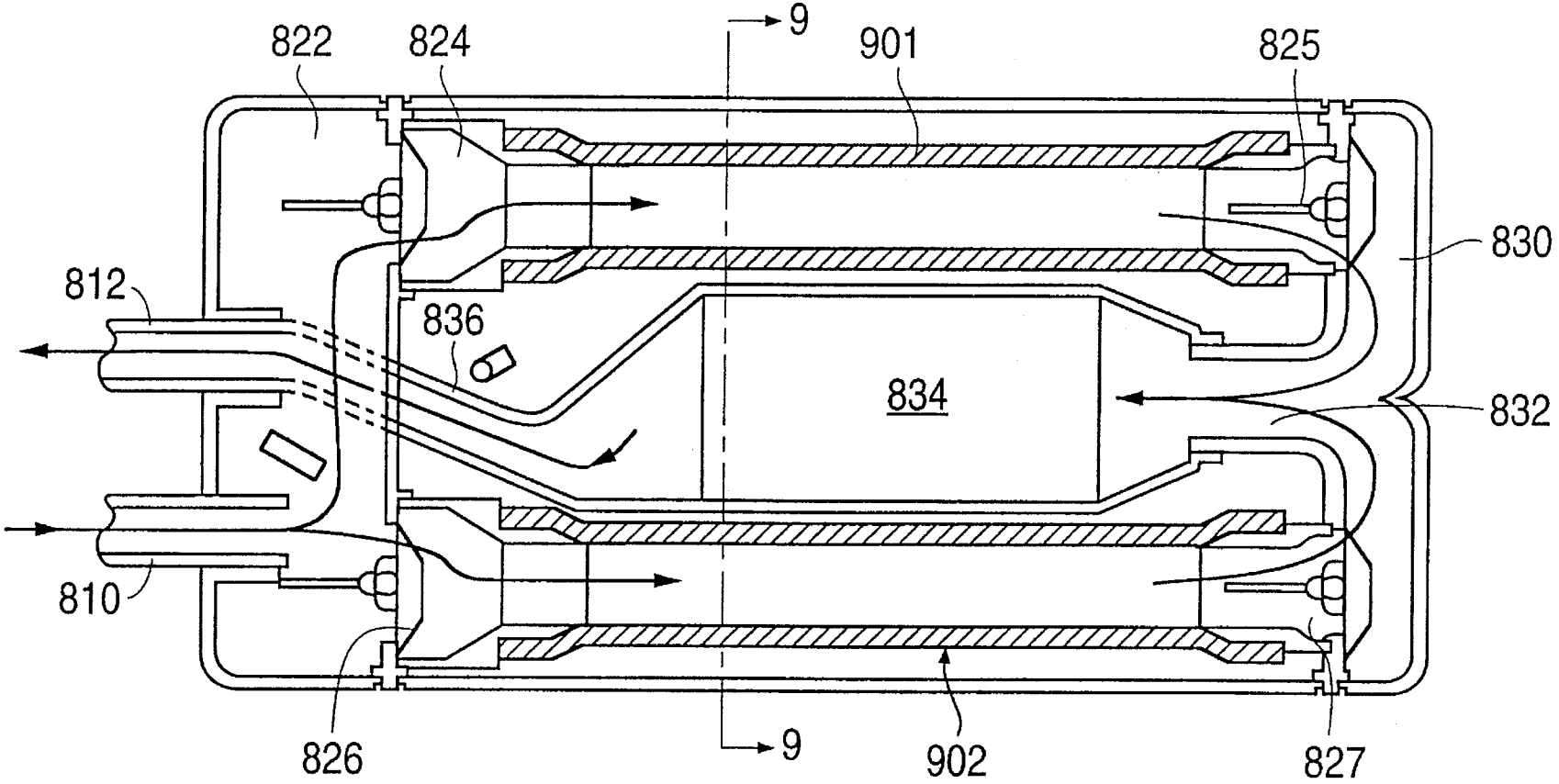

FIG. 8C illustrates a bottom view of the removable sterile cartridge 808. Fluid enters the removable sterile cartridge 808 through the input port 810. As the fluid comes into the input port 810 it enters a first chamber 822. The first chamber is connected to the first tube 901 and the second tube 902 through check valves 824 and 826, respectively. Fluid is pumped through the first and second tubes 901 and 902 under the operation of the rocking pusher mechanism 806 with the check valves 824, 825, 826 and 827. The pumping operation of the check valves to facilitate pumping is similar to the device shown in FIG. 2 and described in connection with the first embodiment. In particular, under the operation of the rocking pusher mechanism 806, fluid is forced out of the first tube 901 (or second tube 902) through the second check valve 825 (or the fourth check valve 827) into a second chamber 830. From the second chamber 830 the fluid is fed through a feed tube 832 into an air (bubble) eliminating filter 834. The air eliminating filter 834 uses both a hydrophilic and a hydrophobic filter to separate the air from the fluid and vent the air to outside. Such an air eliminating filter is similar to those standardly produced by Gellman Science Inc. Membrane & Device Divisions, located in Ann Arbor, Mich., for example, but is adapted to fit within the removable sterile cartridge 808. Once the air is separated from the fluid, the fluid is provided through a feed tube 836 to the output port 812.

Figure 9A:
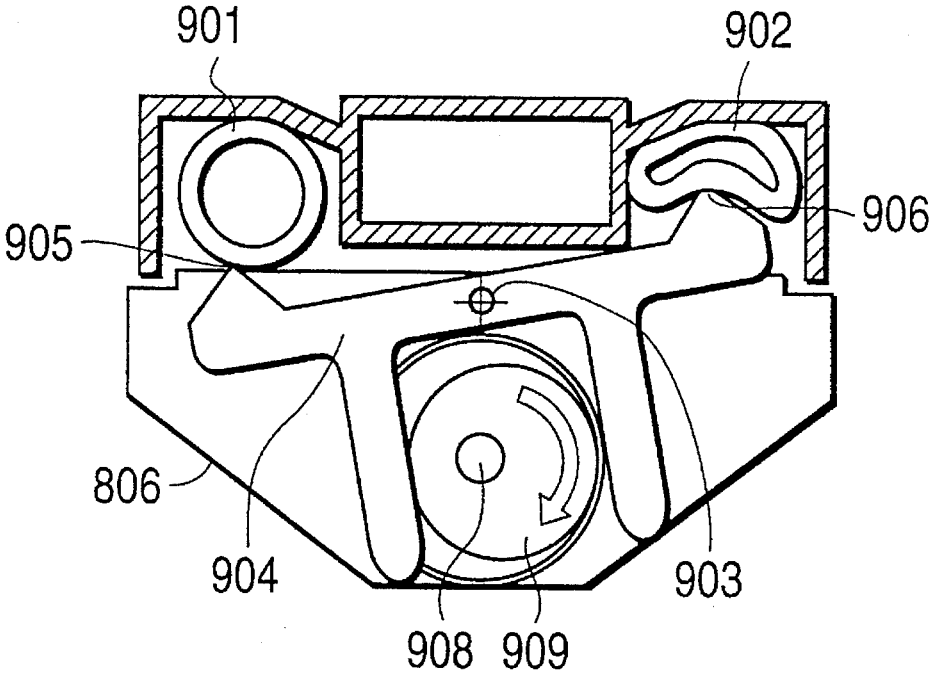
FIGS. 9A and 9B illustrate the operation of the pumping action of the apparatus depicted in FIGS. 8A–8C.
Figure 9B:
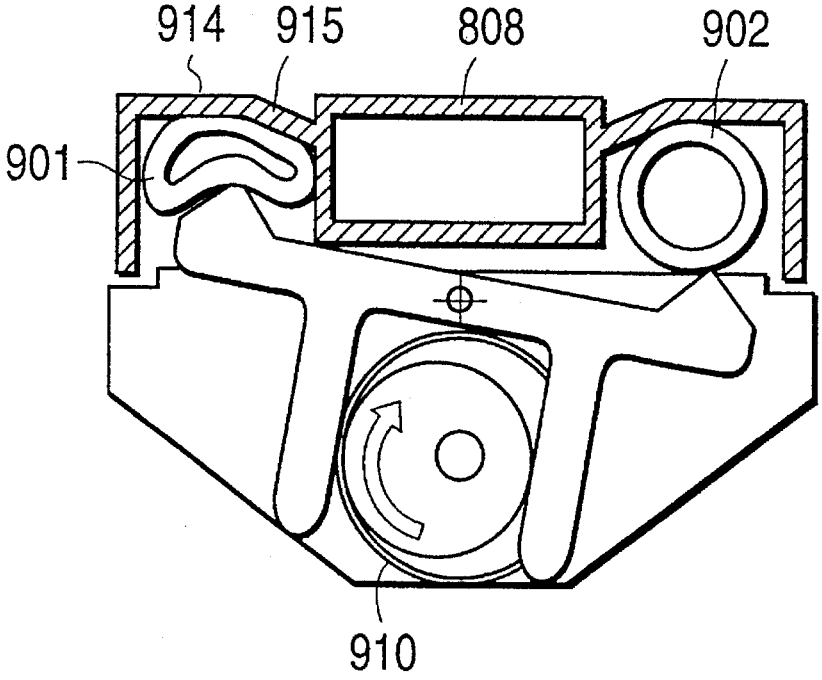

Referring to FIGS. 9A and 9B, the specific operation of the rocking pusher mechanism 806 is described. FIGS. 9A and 9B respectively illustrate a first and second position of the rocking pusher mechanism 806. The portion of the removable sterile cartridge 808 illustrated in FIGS. 9A and 9B is a view taken along the sectional line 9—9 depicted in FIG. 8C.

When the removable sterile cartridge 808 is in place on the main pump body 802, the rocking pusher mechanism 806 is aligned to be in contact with the first and second tubes 901 and 902. The rocking pusher mechanism 806 includes a pivot point 903 around which a rocking member 904 turns. The rocking member 904 includes pusher surfaces 905 and 906 respectively corresponding to the first resilient tube 901 and the second resilient tube 902. The rocking pusher mechanism 806 also includes an eccentric rotating device 909 mounted on a rotating shaft 908. As the eccentric rotating device 909 rotates, it follows the eccentric rotation path 910. As depicted in FIG. 9A, when the eccentric rotating element 909 has its widest portion extending to the right-hand side of the figure, the pusher surface 906 partially occludes the second resilient tube 902. As in the first embodiment, care is taken that the resilient tubes are not completely occluded during the operation of the rocking pusher mechanism 806. As further depicted in FIGS. 9A and 9B, the portion 914 of the removable sterile cartridge 808 includes an angled portion 915. The angled portion 915 is angled so as to be normal to the direction of the push-in surface of the rocking pusher mechanism 806 as it compresses the tube. This helps keep the tube from moving within the portion 914 as the tube is compressed.

FIG. 9B illustrates the operation of the rocker pusher mechanism 806 as the eccentric rotating element rotates through 180°. At this point, the first pushing surface 905 compresses the first resilient tube 901 and the second tube 902 has resumed its original shape. As with the first embodiment, the resiliency of the tube aids the rocking action of the rocking pusher mechanism 806. This rocking motion effectively pumps fluid through the tubes 901 and 902 in the same manner as the oscillating shuttle pump of the first embodiment described above.

A low power pump in accordance with the second embodiment is capable of pumping at a rate of 180 ml/min when pumping water from an IV bag through an 18 gauge needle. The flow rate, of course, would be reduced as the viscosity of the infused solutions increases. The device is also lightweight and compact. Preferably, the length L is approximately 4 inches, the width W is approximately 3½ inches and the height H is approximately 1½ inches. A device having these dimensions weighs approximately 360 g.

In the disclosed embodiment, the flat battery pack 804 may use, for example, two 6 volt lithium batteries connected in series to produce 12 volts. In this configuration, and at the above flow rate, the low power pump 800 is capable of running continuously for a day or longer.

The design of the second embodiment is particularly useful in that it is easily adapted to replace the removable sterile cartridge 808. More particularly, the removable sterile cartridge 808 is simply fitted into place on the main pump body 802. The removable sterile cartridge 808 may be removed and either sterilized and reused, or may comprise a disposable cartridge adapted for one-time use.

Figure 10A:
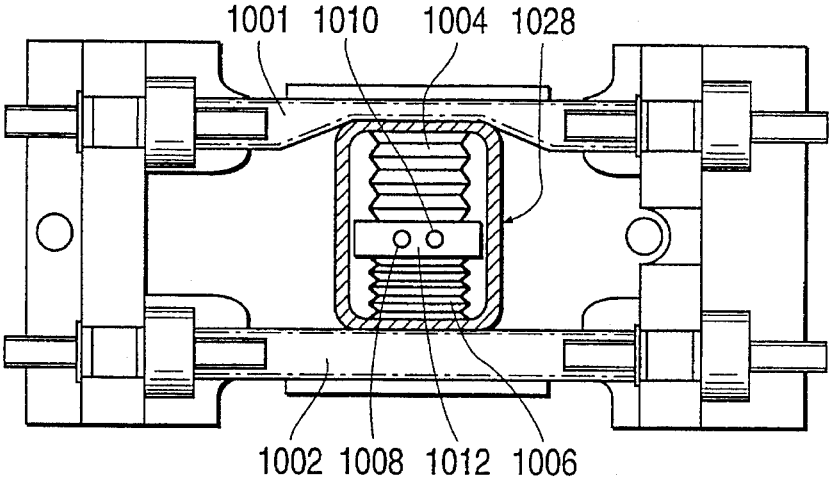
FIGS. 10A and 10B illustrate an alternative driving mechanism according to the instant invention.
Figure 10B:
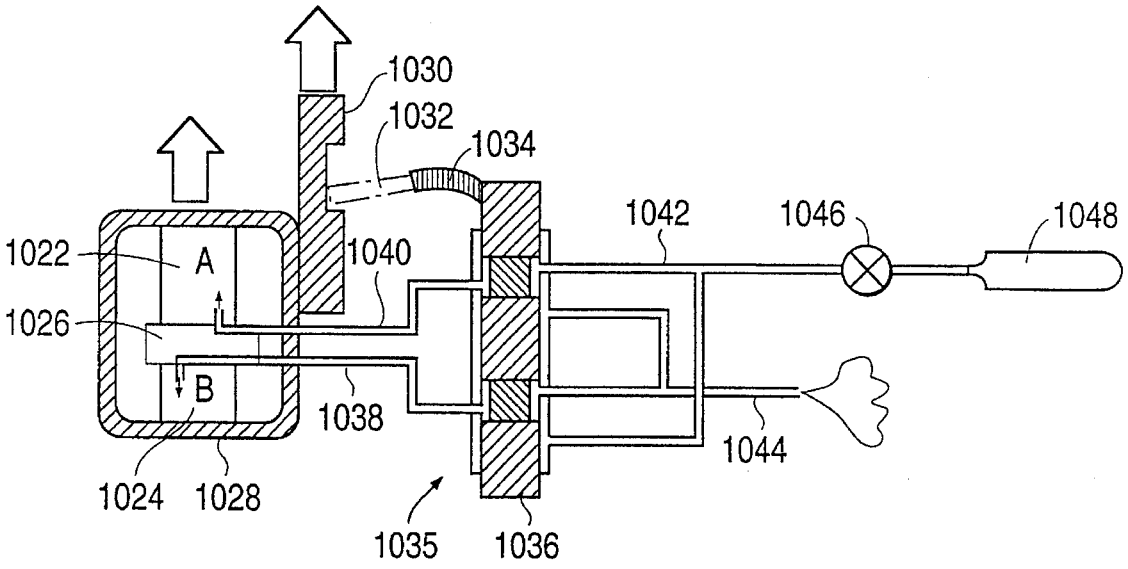

A third embodiment of the instant invention will now be described in connection with FIGS. 10A and 10B. In each of the first and second embodiments, the low power pump comprises two main parts. The first main part is a pump action mechanism (i.e., the shuttle block and driving means or the rocking pusher mechanism) designed to be used with the second main part, which is a removable sterile cartridge portion which includes the tubes and check valves. The cartridge portion is adapted either for use, sterilization, and reuse or for a one-time use disposable system. The pump action mechanism, on the other hand, is designed for many uses over a long period of time. The instant invention, however, can be employed in a completely disposable (i.e., one time use) pump. Such a pump is illustrated in FIGS. 10A and 10B. The pump according to the third embodiment utilizes a gas cartridge 1048 (.e., a pneumatic driving system) rather than the electric power system of the first and second embodiments.

As illustrated in FIG. 10A, a pump according to the third embodiment includes first and second tubes 1001 and 1002 which have a moving shuttle 1028 disposed between them. The device further includes a first expandable section 1022 and a second expandable section 1024. Within the expandable sections, a first diaphragm 1004 and a second diaphragm 1006 are provided. A stationary member 1012 includes a first gas in/out port 1008 and a second gas in/out port 1010. The portion of the pump depicted in FIG. 10B resides in a first plane position above or below the portion depicted in FIG. 10A. The moving shuttle block 1028 extends from the first plane into the plane of the tubes 1001, 1002 to engage the tubes 1001, 1002.

The operation of the device in accordance with the third embodiment will now be described. When the disposable pump is desired to be operated, the gas cartridge 1048 is punctured. The gas is then provided to a feed tube 1049 through a needle valve 1046. Interposed between the needle valve 1046 and a fixed gas feed port 1026 is a feed mechanism 1035 for alternately supplying gas to the first diaphragm 1004 and the second diaphragm 1006, respectively. More particularly, the feed mechanism 1035 includes a toggle actuator 1030 fixed to the moving shuttle 1028. The toggle actuator 1030 acts to move the sliding pilot valve 1036 (stops for the sliding pilot valve 1036 are not shown) between first and second positions. When the sliding pilot valve 1036 is in the first position, the gas provided through feed tube 1042 is supplied to a first diaphragm 1004 through the feed tube 1040. Simultaneously a flow path from the second diaphragm 1006 is established through feed tube 1038 to the exhaust tube 1044. Thus, when the sliding pilot valve 1036 is in its first position, the diaphragm 1004 receives gas from the gas cartridge 1048 and expands thereby causing the moving shuttle to move in a direction toward the first tube 1001. As the moving shuttle 1028 moves in an upward direction, the toggle actuator 1030 reaches a point where it causes the toggle pivot 1032 and the toggle spring 1034 to move the sliding pilot valve 1036 to its second position. When the sliding pilot valve 1036 is in its second position, gas from the gas cartridge 1048 is supplied to the second diaphragm 1006 through the tube 1038. Simultaneously, gas is allowed to exit the exhaust 1044 through the feed tube 1040.

In accordance with the above operation, the moving shuttle 1028 will oscillate between the first tube 1001 and the second tube 1002 as long as gas is provided from the gas cartridge 1048. As in the first and second embodiments, the resilient force of the first and second tubes 1001, 1002 will be imparted to the moving shuttle as it oscillates between the two positions. Thus, the amount of gas needed to move the shuttle between its two positions will be minimized. The operation of the pumping action on the basis of the oscillation of the moving shuttle 1028 between the two tubes 1001 and 1002 will pump the fluid through the tubes as described in connection with the first and second embodiments above. The pneumatic operation of the third embodiment is not limited to the shuttle block embodiment. Such a driving mechanism could also be employed in the rocking pusher geometry of the second embodiment. Thus, in accordance with the third embodiment, an inexpensive, extremely lightweight, portable and disposable pump is disclosed.

An important aspect of the instant invention in connection with each of the above embodiments is its excellent characteristics with regard to pumping cells or blood. The non-occlusive aspect of the pump according to the instant invention avoids the cell damage associated with occlusive designs which cause high shear stresses and cellular damage. To achieve minimum cellular damage, the compression of the tubes is controlled such that a space equal to or larger than the particle size of the cell is left at all times in the tubes. This is possible since total occlusion is not necessary to generate the pumping action. The gentle pumping action of the instant invention provides low hemolysis when blood is being pumped. Damage to cells may still occur in the valves, and in areas of high shear forces and by interaction with the pump materials.

In the first embodiment, by using duck-bill type valves and appropriate material for the tubes, hemolysis can be minimized. In such an embodiment the only point of occlusion is the very tip or edge of the duck bill. In the second embodiment described above, much higher back pressures will be experienced under typical conditions. In this embodiment, in order to minimize compliance of the pumping section, "disk" or "umbrella" type silicon check valves would be employed. This type of check valve is very soft and also has low cracking pressures. They also compress against their backing plates after only a small displacement. In contrast, the nature of the "duck-bill" valve can result in significant compliance as the bill collapses under the increased pressures that are achieved in the pump of the second embodiment. In the extreme, the volume compressed by the rocker or shuttle can equal the compliance volume in the chamber and no fluid is expelled. The effect of changing to the flat valves is that the flow delivered at a given speed, when used with varying back pressure, remains more constant. A small degradation in hemolysis would be expected using such a valve. In the pump of the second embodiment, if the pumps were used to pump blood at 100 ml/min in a resuscitation pump, the pressure could reach as high as 14 psi. If duck-bill valves are used, the pump flow will fall to zero at a pressure of about 8 psi. Thus, the pump of the second embodiment using the flat "disk" or "umbrella" type silicon check valves is more readily adapted to the significant flow rates required for an aggressive resuscitation pump.

In each of the above embodiments, the pump is also small enough to be easily portable. For example, in combat situations, each soldier would be able to carry his own resuscitation pump. Medics or other emergency personnel would be able to carry a number of such pumps without undue weight. The pumps can also be used for extended periods and do not require any external power source.

In the above-described pump configurations, the flow in the two tubes is in the same direction. Thus, the flow profile out of the pump looks like a sine wave with the peak pressure equal to the cracking pressure of the check valve plus the hydrostatic back pressure and a minimum pressure equal to the inlet pressure. If precisely metered flow is required, care must be taken to account for the feature of this design resulting from free flow if the inlet pressure exceeds the check valve cracking pressure plus the outlet pressure.

In another embodiment of the instant invention the pump tubes can also be arranged to flow in opposite directions. This configuration creates a "push-pull" flow situation which would smooth out the pulsating nature of the flow in a closed circulatory system and reduce the ripple effect.

While the above description particularly describes the use of the low power pumps in a medical environment, many other applications are possible. Such pumps have been found very efficient for pumping viscous and abrasive fluids. Pumping of abrasive fluids is improved by the non-occlusive nature of the pump. If the passage through a compressed tube is larger than the abrasive particle, wear will be minimized while maintaining efficient pumping action. The pumps may be used for pumping tissue culture medium for ground-based and space applications. Pumping whole blood or any other type of biological cells for cell culture applications and for toxicological testing may also be accomplished. The pump may be used for pumping viscous detergents into grease traps at timed intervals. This also works best when the compression of the tubes leaves a passage through a compressed tube which is as large or larger than the grease particles.

Due to the low power requirements the pumps of the instant invention could be solar powered, where other power sources are not practical or available. For example, such a pump may be used to deliver plant food to trees on a timed interval where a small solar panel could provide enough power for the brief periods required.

In many arrangements, very small amounts of energy are required to operate the valves. Such pumps become highly efficient.

While the operations of the instant pumps inherently uses two pumping lines, as described above, the lines may be used independently or may be combined to provide twice the flow of a single line with a lower ripple factor. Output from multiple pumps in parallel could also be combined.

In still another embodiment, the pumps may be modified to include means for pressurizing the inlet side which will cause both valves to open and fluid to freely flow through the pump. This allows for easy priming and clearing of air bubbles in pumps where the input pressure+valve cracking pressure is less than the output pressure.

In yet another embodiment, more than 1 tube/side can be accommodated by geometry alterations. For example, four tubes may be used instead of two. For example, a pair of tubes may be placed side by side on each side of the shuttle block. The shuttle block would have a thickness sufficient to compress the pair of tubes simultaneously. Alternatively, the rocker pushing mechanism could be designed to compress more than one tube on each side. A single driving motor may be used to drive more than one shuttle block or other pushing mechanisms. Two such pushing mechanisms, each arranged as described above, may be attached to a single drive shaft. Many other variations of the geometry of the pump can accommodate the features of the instant invention.

In still other applications, with some sacrifice in efficiency, the flow rates on either side may be altered by unbalancing shuttle excursion or shuttle width, by altering the size of the tubes used or by some combination thereof. Additionally, flow rate through one tube may be altered by increasing the distance between the tube and the stop. In this manner the motor speed is unaltered while different flow rates through the tubes can be obtained. The stop may also be made adjustable so that tubes of different diameter can be used in a single pump. Further, adjusting the size of the stop to be smaller than the tube diameter can be used to adjust the pump's flow rate.

These and other uses of the instant invention are possible as defined by the appended claims.

While the invention has been disclosed with reference to certain described embodiments, numerous alterations, modifications, and changes to the described embodiments are possible without departing from the spirit and scope of the invention, as defined in the appended claims and equivalents thereof.

What is claimed is:

1. A method for pumping a fluid through a first resilient tube and a second resilient tube each having original shapes and held in a substantially parallel relationship, said method comprising the steps of:

(a) arranging a pushing mechanism having first and second pushing surfaces adjacent said first and second resilient tubes and with respect to a pivot point such that said first and second pushing surfaces contact said first and second resilient tubes, respectively, and rock in opposite directions;

(b) rocking said pushing mechanism such that the first pushing surface partially compresses said first resilient tube;

(c) discharging a first portion of said fluid from an output end of said first resilient tube as said rocking step (b) partially compresses said first resilient tube;

(d) rocking said pushing mechanism such that said second pushing surface partially compresses said second resilient tube while simultaneously allowing said first resilient tube to resume its said original shape;

(e) discharging a second portion of said fluid from an output end of said second resilient tube as said rocking step (d) partially compresses said second resilient tube; and (f) introducing a third portion of said fluid into said first resilient tube as said first resilient tube resumes its said original shape.

2. A method as recited in claim 1, wherein said rocking step (b) and said rocking step (d) further comprise the steps of:

rotating a shaft having an eccentric on one end, about a rotation axis; and engaging said pushing mechanism with said eccentric such that rotational energy of said shaft is converted into a rocking motion to rock the pushing mechanism.

3. A method as recited in claim 1, wherein said fluid includes biological cells and wherein said discharging step (c), said discharging step (e), and said introducing step (f), further comprise the steps of discharging a first portion of said fluid under low pressure, discharging a second portion of said fluid under low pressure, and introducing a third portion of said fluid under low pressure, respectively, so that damage to said biological cells is minimized.

4. A method as recited in claim 1, wherein said rocking step (b) and said rocking step (d) further comprise the step of utilizing a force exerted by fluid within a compressed tube to urge the pushing mechanism in a direction away from said compressed tube.

5. A method as recited in claim 1, wherein said rocking step (b) and said rocking step (d) further comprise the step of utilizing a force exerted by the resiliency of a compressed tube to urge the pushing mechanism in a direction away from said compressed tube.

6. A pump for pumping a fluid, said pump comprising:

a removable cartridge including a first resilient tube and a second resilient tube each having an original shape;

means adapted to receive said removable cartridge for compressing said first resilient tube into a compressed tube;

means for reciprocating potential energy that is stored in said first resilient tube when said first resilient tube is compressed, to rock said compressing means as said first resilient tube resumes its said original shape wherein reciprocated potential energy aids said compressing means in a subsequent compression of said second resilient tube; and means for discharging a first portion of said fluid from a first end of said first resilient tube as said compressing means compresses said first resilient tube and for introducing a second portion of said fluid to an opposite end of said first resilient tube as said first resilient tube resumes its said original shape.

7. A pump as recited in claim 6, wherein all parts of the pump which contact the fluid are located in the removable cartridge.

8. A pump as recited in claim 7, wherein said removable cartridge is adapted for a one-time use.

9. A pump for pumping a fluid comprising:

a first resilient tube and a second resilient tube each having original shapes;

means for holding said first resilient tube and said second resilient tube in a substantially parallel relationship to each other;

a pushing mechanism having first and second pushing surfaces which are positioned adjacent said first resilient tube and said second resilient tube, respectively, and which are aliqned with respect to a pivot point to rock in opposite directions;

driving means for rocking said pushing mechanism between a first and second position, said first pushing surface of said pushing mechanism partially compressing said first resilient tube when moved to said first position and said second pushing surface partially compressing said second resilient tube when moved to said second position;

a first input valve connected to one end of said first resilient tube and a first output valve connected to an opposite end of said first resilient tube; and a second input valve connected to one end of said second resilient tube and a second output valve connected to an opposite end of said second resilient tube, wherein a first portion of said fluid is pumped out of said first resilient tube through said first output valve as said first pushing surface compresses said first resilient tube while a second portion of said fluid is drawn into said second resilient tube through said second input valve as said second resilient tube resumes its said original shape.

10. A pump as recited in claim 9, wherein said driving means comprises a high efficiency electric motor.

11. A pump as recited in claim 10, wherein said electric motor is powered by a battery power source.

12. A pump as recited in claim 1, wherein said first and said second input valves and said first and said second output valves comprise check valves.

13. A pump as recited in claim 5, wherein said check valves are umbrella check valves.

14. A pump for pumping a fluid comprising:

a first resilient tube and a second resilient tube each having original shapes;

means for holding said first resilient tube and said second resilient tube in a substantially parallel relationship to each other;

a pushing mechanism having first and second pushing surfaces positioned adjacent said first resilient tube and said second resilient tube, respectively;

a high efficiency electric motor for rocking said pushing mechanism between a first and second position, said first pushing surface of said pushing mechanism partially compressing said first resilient tube when moved to said first position and said second pushing surface partially compressing said second resilient tube when moved to said second position;

a first input valve connected to one end of said first resilient tube and a first output valve connected to an opposite end of said first resilient tube;

a second input valve connected to one end of said second resilient tube and a second output valve connected to an opposite end of said second resilient tube, wherein a first portion of said fluid is pumped out of said first resilient tube through said first output valve as said first pushing surface compresses said first resilient tube while a second portion of said fluid is drawn into said second resilient tube through said second input valve as said second resilient tube resumes its said original shape;.

a rotating shaft extending from said electric motor; and an eccentric means on an end of said rotating shaft for engaging said pushing mechanism and converting rotational motion of said rotating shaft into a rocking motion to rock said pushing mechanism.

* * * * *